US005470683A

United States Patent [19]

Inaishi

[11] Patent Number: 5,470,683

[45] Date of Patent: Nov. 28, 1995

[54] PHOTOSENSITIVE MICROCAPSULE TONER

[75] Inventor: Kouji Inaishi, Okazaki, Japan

[73] Assignee: Brother Kogyo Kabushiki Kaisha, Nagoya, Japan

[21] Appl. No.: 272,427

[22] Filed: Jul. 11, 1994

[30] Foreign Application Priority Data

Jul. 28, 1993 [JP] Japan ..... 5-186110

[51] Int. Cl.[6] ..... G03G 9/09; G03G 9/093

[52] U.S. Cl. ..... 430/106; 430/138

[58] Field of Search ..... 430/106, 138

[56] References Cited

U.S. PATENT DOCUMENTS

| | | | |
|---|---|---|---|
| 2,548,366 | 4/1951 | Green et al. | 282/28 |
| 2,730,456 | 1/1956 | Green et al. . | |
| 2,800,457 | 7/1957 | Green et al. . | |
| 2,800,458 | 7/1957 | Green . | |
| 2,969,331 | 1/1961 | Brynko et al. . | |
| 3,111,407 | 11/1963 | Lindquist et al. . | |
| 3,281,383 | 10/1966 | Zelinski et al. . | |
| 3,287,154 | 11/1966 | Haas . | |
| 3,418,250 | 12/1968 | Vassiliades . | |
| 3,551,346 | 12/1970 | Breen . | |
| 3,576,660 | 4/1971 | Bayless et al. . | |
| 3,578,605 | 5/1971 | Baxter . | |
| 3,660,304 | 5/1972 | Matsukawa . | |
| 3,726,803 | 4/1973 | Bayless et al. | 252/62.54 |
| 3,755,190 | 8/1973 | Hart et al. . | |
| 3,773,695 | 11/1973 | Argabright et al. . | |
| 3,788,994 | 1/1974 | Wellman et al. | 430/109 |
| 3,793,268 | 2/1974 | Dietich et al. . | |
| 3,796,669 | 3/1974 | Kiritani et al. . | |
| 3,803,046 | 4/1974 | Winyall et al. | 423/338 |
| 3,816,331 | 6/1974 | Brown, Jr. et al. | 252/314 |
| 4,001,140 | 1/1977 | Foris et al. | 427/151 |
| 4,016,099 | 4/1977 | Wellman et al. | 252/314 |
| 4,025,455 | 5/1977 | Shackle | 427/339 |
| 4,087,376 | 5/1978 | Foris et al. | 427/152 |
| 4,089,802 | 5/1978 | Foris et al. | 427/151 |
| 4,399,209 | 8/1983 | Sanders et al. | 430/138 |
| 4,416,966 | 11/1983 | Sanders et al. | 430/138 |
| 4,576,891 | 3/1986 | Adair et al. | 430/138 |
| 5,213,940 | 5/1993 | Inaishi et al. | 430/138 |
| 5,215,855 | 6/1993 | Keoshkerial et al. | 430/138 |
| 5,260,158 | 11/1993 | Yamaji et al. | 430/106 |

FOREIGN PATENT DOCUMENTS

| | | |
|---|---|---|
| 879043 | 8/1971 | Canada . |
| 36-9168 | 6/1951 | Japan . |
| 38-19574 | 9/1963 | Japan . |
| 42-771 | 1/1967 | Japan . |
| 42-446 | 1/1967 | Japan . |
| 48-22443 | 3/1973 | Japan . |
| 48-65011 | 11/1973 | Japan . |
| 48-40347 | 11/1973 | Japan . |
| 48-95420 | 12/1973 | Japan . |
| 49-24159 | 6/1974 | Japan . |
| 51-16807 | 2/1976 | Japan . |
| 51-28589 | 8/1976 | Japan . |
| 51-35867 | 10/1976 | Japan . |
| 51-132838 | 11/1976 | Japan . |
| 52-12150 | 4/1977 | Japan . |
| 54-8104 | 4/1979 | Japan . |
| 56-119138 | 9/1981 | Japan . |
| 57-124343 | 8/1982 | Japan . |
| 57-170857 | 10/1982 | Japan . |
| 57-179836 | 11/1982 | Japan . |
| 61-260038 | 11/1982 | Japan . |
| 57-202547 | 12/1982 | Japan . |
| 57-197538 | 12/1982 | Japan . |
| 58-88740 | 5/1983 | Japan . |

(List continued on next page.)

*Primary Examiner*—Roland Martin
*Attorney, Agent, or Firm*—Oliff & Berridge

[57] ABSTRACT

A photosensitive microcapsule toner encapsulating a photocurable composition is excellent in weather resistance, and is curable by application of low energy visible light, particularly light having a wavelength not less than 600 nm. The photocurable composition is composed of a radical polymerizable unsaturated group-bearing compound, a metal arene compound as a polymerization initiator, a spectral sensitizing dye, and a color material.

14 Claims, 1 Drawing Sheet

FOREIGN PATENT DOCUMENTS

| | | |
|---|---|---|
| 58-88739 | 5/1983 | Japan . |
| 58-153947 | 9/1983 | Japan . |
| 58-176643 | 10/1983 | Japan . |
| 60-57859 | 4/1985 | Japan . |
| 60-136542 | 7/1985 | Japan . |
| 60-174750 | 9/1985 | Japan . |
| 60-228448 | 11/1985 | Japan . |
| 60-227161 | 11/1985 | Japan . |
| 60-259490 | 12/1985 | Japan . |
| 61-130495 | 6/1986 | Japan . |
| 61-167680 | 7/1986 | Japan . |
| 61-167681 | 7/1986 | Japan . |
| 61-145143 | 7/1986 | Japan . |
| 61-143370 | 7/1986 | Japan . |
| 61-218551 | 9/1986 | Japan . |
| 61-218550 | 9/1986 | Japan . |
| 61-238755 | 10/1986 | Japan . |
| 61-243862 | 10/1986 | Japan . |
| 62-465 | 1/1987 | Japan . |
| 62-432 | 1/1987 | Japan . |
| 62-174195 | 7/1987 | Japan . |
| 62-162147 | 7/1987 | Japan . |
| 62-209531 | 9/1987 | Japan . |
| 62-209444 | 9/1987 | Japan . |
| 63-32560 | 2/1988 | Japan . |
| 63-177145 | 7/1988 | Japan . |
| 1-146844 | 6/1989 | Japan . |
| 1-146845 | 6/1989 | Japan . |
| 1-146846 | 6/1989 | Japan . |
| 1-146847 | 6/1989 | Japan . |
| 1-146851 | 6/1989 | Japan . |
| 1-146864 | 6/1989 | Japan . |
| 1-146842 | 6/1989 | Japan . |
| 1-228961 | 9/1989 | Japan . |
| 1-230674 | 9/1989 | Japan . |
| 1-228960 | 9/1989 | Japan . |
| 2-19858 | 5/1990 | Japan . |
| 4-249250 | 4/1992 | Japan . |
| 927807 | 6/1963 | United Kingdom . |
| 930422 | 7/1963 | United Kingdom . |
| 965074 | 7/1964 | United Kingdom . |
| 990443 | 4/1965 | United Kingdom . |

PHOTOSENSITIVE MICROCAPSULE TONER

BACKGROUND OF THE INVENTION

1. Field of the Invention

The present invention relates to toners for use in a color copying machine such as of an electrophotographic type, etc. and, more particularly, to photosensitive microcapsule toners which are cured by exposure to light having a specific wavelength.

2. Description of the Related Art

Conventional copying processes in color copying machines using microcapsules are generally classified into two types: an electrophotographic type and a transfer developing type.

Color copying machines of the electrophotographic type employ microcapsule toners encapsulating an ink component as described in U.S. Pat. Nos. 3,788,994 and 4,016,099; Japanese Patent Publication Nos. Sho 51-35867 and Sho 54-8104; and Japanese Patent Laid-open Nos. Sho 51-132838, Sho 56-119138, Sho 57-202547, Sho 58-153947, Sho 58-176643, Sho 59-170857, Sho 60-57859, Sho 60-227161, Sho 63-32560, and Sho 63-177145.

In such color copying machines, the microcapsule toner is constituted of microcapsule toners of four colors, i.e., yellow, magenta, cyan, and black. These toners are used to form images of these colors on a photosensitive body. Then, the microcapsule toner having such a multicolor image formed on the photosensitive body is transferred onto a recording medium. Then, the recording medium on which the multicolor image has been transferred is heated or pressurized to fix the ink component encapsulated in the microcapsule toner to the recording medium.

On the other hand, color copying machines of the transfer developing type employ microcapsules encapsulating photosensitive resins and coloring matter components as described in U.S. Pat. Nos. 2,548,366, 4,399,209, 4,416,966, and 4,576,891; and Japanese Patent Laid-open Nos. Sho 48-65011, Sho 48-95420, Sho 51-16807, Sho 57-124343, Sho 57-179836, Sho 57-197538, Sho 58-88739, Sho 58-88740, Sho 60-259490, Sho 61-130945, Sho 62-162147, Sho 62-174195, Sho 62-209444, and Sho 62-209531.

In such color copying machines, three kinds of microcapsules encapsulating dye precursors, dyes or pigments of three colors, i.e., yellow, magenta, and cyan are used. These microcapsules have the following characteristics. The microcapsules encapsulating a chromogen for cyan are cured (i.e. rendered solid) by exposure to light having a wavelength of about 650 nm (red light). Microcapsules encapsulating a chromogen for magenta are cured by exposure to light having a wavelength of about 550 nm (green light). Microcapsules encapsulating a chromogen for yellow are cured by exposure to light having a wavelength of about 450 nm (blue light).

These microcapsules are uniformly applied to a carrier sheet to prepare a photosensitive microcapsule coated sheet. The photosensitive microcapsule coated sheet is irradiated with red, green, and blue lights at the same time or separately, thus forming a latent image. Then, the photosensitive microcapsule coated sheet on which the latent image has been formed is heated or pressurized to rupture uncured microcapsules and transfer the encapsulated substance onto a recording medium on which a developer has been coated.

For microcapsule toners of the electrophotographic type mentioned above, four toner tanks are necessary because the toners of four colors are used, causing an increase in cost of the machine. Further, the transfer process to the recording medium is necessarily carried out four times, so that an error in color registering can easily occur.

On the other hand, systems of the transfer developing type have an advantage in that analog exposure can be carried out to thereby reduce the number of steps in the copying process as compared to systems of the electrophotographic type. However, since systems of the transfer developing type need photosensitive microcapsule coated sheets and developer coated recording mediums, these systems consume a large quantity of materials. This causes an increase in running cost. Further, as the photocurable microcapsule coated sheets must be stored in a cool, dark place, it is necessary for a user to secure such a storage place. Similar to a once-through ribbon used for thermal transfer, an unused part of the photosensitive microcapsule coated sheet remains unused, and it is sometimes wasted.

In these circumstances, the present applicant has already proposed in Japanese Laid Open Patent Publication No. Hei 4-249250 a photosensitive microcapsule toner having the features of both types mentioned above. Japanese Laid Open Patent Publication No. Hei 4-249250 discloses a photocurable composition microcapsule toner comprising a radical polymerizable unsaturated group-bearing compound and a metal arene compound as a polymerization initiator and a spectral sensitizing dye.

However, the sensitivity of the photosensitive microcapsule toners proposed above does not fully meet the requirements on recent high-speed machines. In particular, there is a demand for improving the sensitivity of microcapsules which are sensitive to exposure of light having a wavelength of about 650 nm (red light). However, there is a tendency for the improvement in the sensitivity to cause a reduction in temperature and humidity resistance of an image finally formed.

SUMMARY OF THE INVENTION

An object of the present invention is to solve the above problems by providing a photosensitive microcapsule toner encapsulating a photocurable composition that is excellent in temperature and humidity resistance and which is capable of being cured at low energy by visible light, and particularly light having a wavelength not less than 600 nm.

According to the present invention, there is provided a photosensitive microcapsule toner having a photocurable composition as a core substance, the photocurable composition comprising a radical polymerizable unsaturated group-containing compound, a metal arene compound as a photopolymerization initiator, a spectral sensitizing dye, and a color material.

In photosensitive microcapsule toners of the present invention, the photocurable composition is cured at a specific wavelength of light by the action of the spectral sensitizing dye. Unexposed, and thus uncured, photosensitive microcapsule toners containing the photocurable composition are ruptured and transferred onto a recording medium, thus recording a toner image on the recording medium.

As will be apparent, the photosensitive microcapsule toner of the present invention is capable of being cured at low energy by visible light, particularly light having a wavelength not less than 600 nm. Accordingly, the exposure time can be shortened to thereby cope with high operating speed of an image forming apparatus. Further, fading of the formed image does not occur, and the formed image can be utilized in high temperature and humidity conditions without image degradation.

DETAILED DESCRIPTION OF PREFERRED EMBODIMENTS

Figure 1:
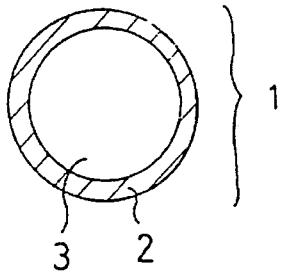
FIG. 1 is an enlarged sectional view of a photosensitive microcapsule toner.

Referring to FIG. 1, there is shown a photosensitive microencapsulated toner 1 of the present invention. The photosensitive microcapsule toner 1 has a structure that includes a photosensitive composition 3 as a photocurable composition of the present invention encapsulated in an outer shell 2. The photosensitive composition 3 comprises at least a radical polymerizable unsaturated group-containing compound, a metal arene compound as a photopolymerization initiator, a spectral sensitizing dye, and a color material. Preferably, the color material is a material different than the spectral sensitizing dye.

The photosensitive composition includes 100 parts by weight of the radical polymerizable unsaturated group-containing compound, 0.01–60 parts by weight of the metal arene compound as the photopolymerization initiator, 0.005–50 parts by weight of the spectral sensitizing dye and 0.1–60 parts by weight of the color material. More preferably, the photosensitive composition includes 100 parts by weight of the radical polymerizable unsaturated group-containing compound, 0.1–20 parts by weight of the metal arene compound, 0.01–10 parts by weight of the spectral sensitizing dye, and 0.1–60 parts by weight of the color material.

Examples of the radical polymerizable unsaturated group-containing compound useful in the present invention include, but are not limited to, N-vinyl-2-pyrrolidone, bisphenol A diacrylate, bisphenol A dimethacrylate, tripropylene glycol diacrylate, tripropylene glycol dimethacrylate, pentaerythritol triacrylate, pentaerythritol trimethacrylate, dipentaerythritol hexaacrylate, dipentaerythritol hexamethacrylate, trimethylolpropane triacrylate, and trimethylolpropane trimethacrylate. These radical polymerizable unsaturated group-containing compounds may be used singly or in combination.

Examples of the metal arene compound useful as the photopolymerization initiator in the present invention have, for example, the structure represented by the following general formula:

Formula 1

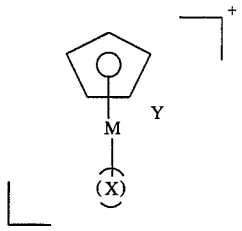

wherein X represents a group containing at least one benzene ring; Y represents a basic ion such as $BF_4^-$, $PF_6^-$, $AsF_6^-$ or $SbF_6^-$; and M represents a metal such as iron, nickel or cobalt.

Examples of the spectral sensitizing dye useful in the present invention include, but at not limited to, xanthene dyes, coumarin dyes, merocyanine dyes, thiazine dyes, azine dyes, methine dyes, oxazine dyes, phenylmethane dyes, cyanine dyes, azo dyes, anthraquinone dyes, pyrazoline dyes, stilbene dyes, quinoline dyes, squarylium dyes, and mixtures thereof, Examples of squarylium dyes useful in the present invention include those set forth in Japanese Patent Laid-open Nos. Sho 48-22443, Sho 60-136542, Sho 60-174750, Sho 60-228448, Sho 61-143370, Sho 61-145143, Sho 61-167680, Sho 61-167681, Sho 61-218550, Sho 61-218551, Sho 61-238755, Sho 61-243862, Sho 61-260038, Sho 62-432 and Sho 62-465 and Hei 1-146842, Hei 1-146844, Hei 1-146845, Hei 1-146846, Hei 1-146847, Hei 1-146851, Hei 1-146864, Hei 1-228960, Hei 1-228961 and Hei 1-230674, and Japanese Patent Publication No. Hei 2-198585. Of these, preferred squarylium dyes are those having the structure represented by the following general formula:

Formula 2

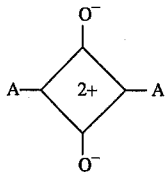

wherein each A represents a substituted or unsubstituted condensed ring group, a methylene group double bonded to a substituted or unsubstituted heterocyclic ring, or a substituted or unsubstituted aminophenol group.

For example, squarylium dyes having the structures represented by the following formulas may be used.

Formula 3

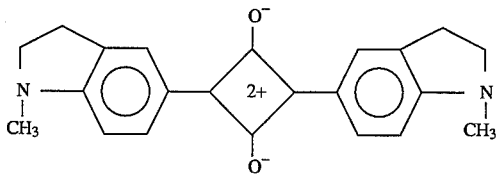

Formula 4

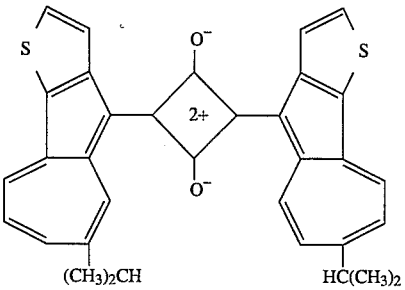

Formula 5

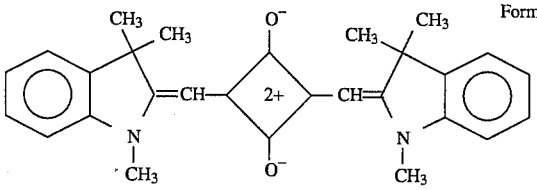

-continued

Formula 6

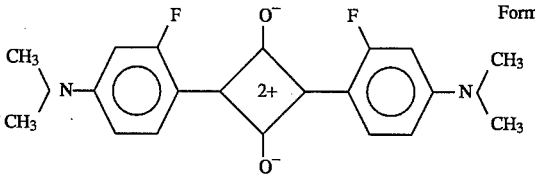

Examples of the color material to be used in the present invention may include any dyes and pigments that can be dissolved or dispersed in the radical polymerizable unsaturated group-containing compound, such as inorganic pigments, for example, carbon black, chrome yellow, red oxide, titanium oxide, and molybdate orange; and organic pigments, for example, phthalocyanine, azo, azo lake, anthrapyrimidine, isoindolinone, quinacridone, and perylene.

If necessary, the photosensitive microcapsule toner may further comprise thermal polymerization inhibitors, sensitizers, surface active agents, solvents, microcapsule wall forming agents, and the like, provided that they do not inhibit the toner's photosensitive characteristics.

The photosensitive microcapsule toner 1 may be manufactured by any procedure known in the art such as described, for example, in U.S. Pat. Nos. 2,730,456, 2,800,457, 2,800,458, 2,969,331, 3,111,407, 3,281,383, 3,287,154, 3,418,250, 3,551,346, 3,576,660, 3,578,605, 3,660,304, 3,726,803, 3,755,190, 3,773,695, 3,793,268, 3,796,669, 3,803,046, 3,816,331, 4,001,140, 4,025,455, 4,087,376, and 4,089,802; British Patents Nos. 927,807, 930,422, 965,074, and 990,443; Canadian Patent No. 879,043; and Japanese Patent Publications Nos. Sho 36-9168, Sho 38-19574, Sho 42-446, Sho 42-771, Sho 48-40347, Sho 49-24159, Sho 51-28589, and Sho 52-12150. However, the manufacturing method for the photosensitive microcapsule toner 1 is not limited to those known methods. Further, the microcapsule wall forming agents mentioned above preferably have a property of sufficiently transmitting light.

The mechanism of the curing reaction of the photocurable composition of the photosensitive microcapsule toner according to the present invention is not fully understood, but without desiring to be bound by any theory is considered as follows:

The spectral sensitizing dye absorbs light and is excited. When the excited spectral sensitizing dye is returned to the ground state, the metal arene compound is activated by movement of electrons or energy released. The activated metal arene compound contributes to generation of radicals from the radical polymerizable unsaturated group-containing compound. The resultant radicals cause the radical polymerizable unsaturated group-containing compound to be polymerized.

The present invention will be more clearly understood with reference to the following example.

EXAMPLE

Into 95 parts by weight of polyethylene glycol diacrylate (Aronix M240 manufactured by TOAGOSEI CHEMICAL INDUSTRY CO., LTD.) and dipentaerythritol hexaacrylate (Aronix M400 manufactured by TOAGOSEI CHEMICAL INDUSTRY CO., LTD.) at a ratio of 3:4, both as a radical polymerizable unsaturated group-containing compound, is dispersed 5 parts by weight of phthalocyanine pigment.

10 parts by weight of the above dispersion, 1.5 by weight of an iron arene compound having the following formula as the polymerization initiator:

Formula 7

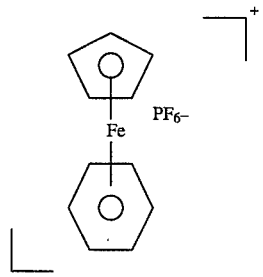

and 0.5 parts by weight of squarylium dye having the following formula as the spectral sensitizing dye:

Formula 8

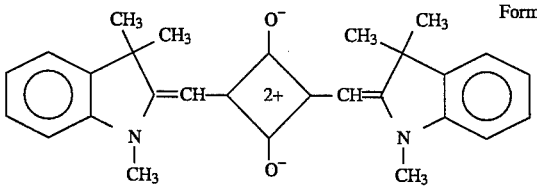

are mixed and ultrasonically dispersed for 5 minutes. The resultant dispersion is heated at 100° C. for 10 minutes to obtain a photosensitive composition.

Into this composition, 0.2% of adipic acid is dissolved to obtain a core substance for the toner.

30% of polyoxyethylene sorbitan tristearate (Rheodol TW-S320 manufactured by Kao Corporation) and 0.2% of hexamethylenediamine are dissolved into 100 g of water.

Into 100 g of this aqueous solution, 50 g of the above-mentioned core substance is emulsified, followed by polymerization to form a wall substance on the interface between the core substance and the aqueous solution, thereby obtaining microcapsules. The microcapsules are dried to obtain a photosensitive microcapsule toner.

Figure 2:
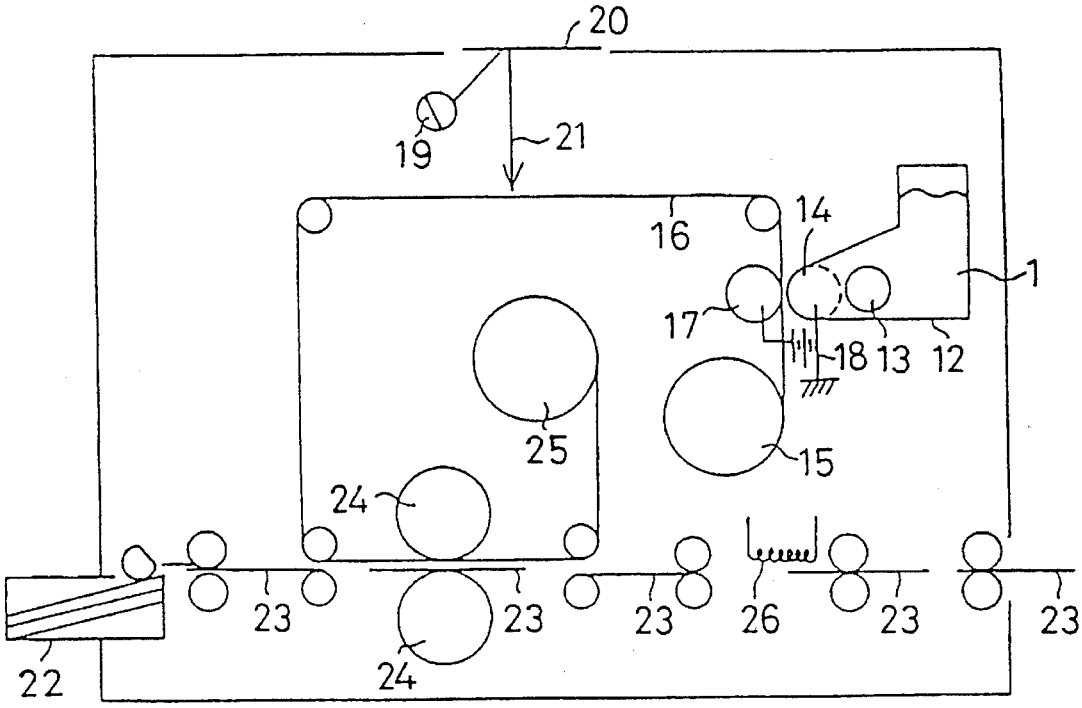
FIG. 2 is a schematic sectional view of an image forming apparatus using the photosensitive microcapsule toner.

Now, image formation by the photosensitive microcapsule toner in the preferred embodiment will be described with reference to FIG. 2 which is a schematic sectional view of an image forming apparatus using the photosensitive microcapsule toner in the preferred embodiment.

A photosensitive microcapsule toner 1 of the preferred embodiment is enclosed in a toner tank 12. A charging roller 13 is rotatably mounted in the toner tank 12. The photosensitive microcapsule toner 1 enclosed in the toner tank 12 is a mixture of three kinds of toners, i.e., a photosensitive yellow microcapsule toner, a photosensitive magenta microcapsule toner, and a photosensitive cyan microcapsule toner, which are uniformly mixed in equal amounts. The photosensitive microcapsule toner 1 is triboelectrically charged by rotation of the charging roller 13. A carrier roller 14 is rotatably mounted in the toner tank 12 at a front end thereof. The photosensitive microcapsule toner 1 charged above is carried out of the toner tank 12 by the carrier roller 14.

A polyethylene terephthalate (PET) sheet 16 is unwound from a supply roll 15 to pass between the carrier roller 14 and an opposite roller 17. The opposite roller 17 is located in symmetry with the carrier roller 14 with respect to the PET sheet 16. An electrode 18 is connected to the carrier roller 14 and the opposite roller 17. The photosensitive microcapsule toner 1 carried on the carrier roller 14 is electrostatically applied to the surface of the PET sheet 16 facing the carrier roller 14 by means of the electrode 18.

An original 20 is irradiated with light emitted from a light source 19. The light is reflected on the original 20, and is directed as a reflected light 21 to the surface of the PET sheet 16 on which the photosensitive microcapsule toner 1 is applied. At this time, the photosensitive microcapsule toner 1 is cured (solidified) in portions where it is exposed to the reflected light 21. In this manner, a latent image is formed on the PET sheet 16.

Then, the latent image bearing surface of the PET sheet 16 is brought into close contact with a recording medium 23 supplied from a paper feed cassette 22. In this close contact condition, the PET sheet 16 and the recording medium 23 are nipped by a pair of pressure rollers 24. At this time, the photosensitive microcapsule toners 1 which remain unreacted are ruptured by a nipping pressure applied from the pressure rollers 24. The core substances of the photosensitive microcapsule toners 1 thus ruptured are deposited on the recording medium 23, thereby transferring a toner image onto the recording medium 23. Thereafter, the PET sheet 16 is wound up around a take-up roll 25. The toner image transferred onto the recording medium 23 is fixed thereto by a noncontact type heat fixing device 26. Then, the recording medium 23 on which the toner image has been recorded is delivered out of the apparatus.

Thus, the whole recording process with use of the photosensitive microcapsule toner according to the preferred embodiment is completed. In this process, energy for curing the photosensitive microcapsule toner is 5213.01 erg/cm$^2$ at a maximum curing wavelength of 630 nm. Thus, the photocurable microcapsule toner in the preferred embodiment is well cured even at low energy of long-wavelength light because the squarylium dye is used. Further, even when the recorded image is exposed to light from a xenon lamp for 32 hours, no change in color is visibly perceived.

It is to be noted that the present invention is not limited to the preferred embodiment mentioned above, but various changes in constitution or operation may occur without departing from the scope of the present invention as set forth in claims. For example, the wall of the microcapsule may have a multilayer structure having two or more layers. The outer shell of the microcapsule may have various additional functions. Various additions may be provided outside the outer shell of the microcapsule. The radical polymerizable unsaturated group-containing compound may be a solid, which may be heated to melt during the photoreaction.

What is claimed is:

1. Photosensitive microcapsule toner comprising; an outer shell; and a photocurable composition as a core, said photocurable composition comprising at least one radical polymerizable unsaturated group-containing compound, at least one metal arena compound as a polymerization initiator, at least one spectral sensitizing dye that is a squarylium dye, and at least one color material, wherein said photosensitive microcapsule toner is curable by visible light.

2. Photosensitive microcapsule toner according to claim 1, wherein said color material is dissolved or dispersed in the radical polymerizable unsaturated group-containing compound.

3. Photosensitive microcapsule toner according to claim 1, wherein said color material comprises an inorganic pigment.

4. Photosensitive microcapsule toner according to claim 3, wherein said inorganic pigment comprises at least one member selected from the group consisting of carbon black, chrome yellow, red oxide, titanium oxide and molybdate orange.

5. Photosensitive microcapsule toner according to claim 1, wherein said color material comprises organic pigment.

6. Photosensitive microcapsule toner according to claim 5, wherein said organic pigment comprises at least one member selected from the group consisting of phthalocyanine, azo, azo lake, anthrapyrimidine, isoindolinone, quinacridone and perylene.

7. Photosensitive microcapsule toner according to claim 1, wherein the photocurable composition further comprises at least one member selected from the group consisting of thermal polymerization inhibitor, sensitizer, surface active agent, solvent and microcapsule wall forming agent.

8. Photosensitive microcapsule toner according to claim 1, wherein said squarylium dye has a structure represented by the following formula:

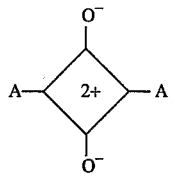

wherein each A represents a substituted or unsubstituted condensed ring group, a methylene group double bonded to a substituted or unsubstituted heterocyclic ring, or a substituted or unsubstituted aminophenol group.

9. Photosensitive microcapsule toner according to claim 8, wherein said squarylium dye has a structure represented by the following formula:

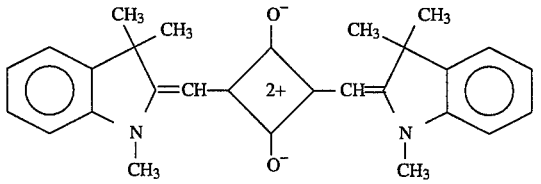

10. Photosensitive microcapsule toner according to claim 1, wherein the polymerizable unsaturated group-containing compound is selected from the group consisting of N-vinyl-2-pyrrolidone, bisphenol A diacrylate, bisphenol A dimethacrylate, tripropylene glycol diacrylate, tripropylene glycol dimethacrylate, pentaerythritol triacrylate, pentaerythritol trimethacrylate, dipentaerythritol hexaacrylate, dipentaerythritol hexamethacrylate, trimethylolpropane triacrylate, trimethylolpropane trimethacrylate, and mixtures thereof.

11. Photosensitive microcapsule toner according to claim 1, wherein the metal arene compound has a structure represented by the following formula:

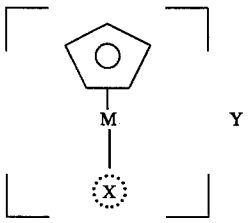

wherein X represents a group containing at least one benzene ring, Y represents a basic ion, and M represents a metal.

12. Photosensitive microcapsule toner according to claim 11, wherein Y represents a basic ion selected from the group consisting of $BF_4^-$, $PF_6^-$, $AsF^-$ and $SbF_6^-$.

13. Photosensitive microcapsule toner according to claim 11, wherein M represents a metal selected from the group consisting of iron, nickel and cobalt.

14. Photosensitive microcapsule toner according to claim 1, wherein said toner is curable by a light having a wavelength not less than 600 nm.

* * * * *